US009809970B2

(12) United States Patent
Burns

(10) Patent No.: US 9,809,970 B2
(45) Date of Patent: Nov. 7, 2017

(54) COLLAPSIBLE AND PORTABLE MODULAR DECK SYSTEM

(71) Applicant: Darquise R Burns, Little Britain (CA)

(72) Inventor: Darquise R Burns, Little Britain (CA)

( * ) Notice: Subject to any disclaimer, the term of this patent is extended or adjusted under 35 U.S.C. 154(b) by 18 days.

(21) Appl. No.: 14/866,805

(22) Filed: Sep. 25, 2015

(65) Prior Publication Data

US 2017/0089057 A1 Mar. 30, 2017

(51) Int. Cl.

| | |
|---|---|
| ***E04H 15/50*** | (2006.01) |
| ***E04B 1/00*** | (2006.01) |
| ***E04B 1/343*** | (2006.01) |
| ***E04B 5/02*** | (2006.01) |
| ***E04F 15/024*** | (2006.01) |

(52) U.S. Cl.

CPC ..... *E04B 1/003* (2013.01); *E04B 1/34321* (2013.01); *E04B 1/34384* (2013.01); *E04B 5/02* (2013.01); *E04F 15/024* (2013.01); *E04H 15/50* (2013.01)

(58) Field of Classification Search

CPC . E04B 1/003; E04H 3/28; E04H 15/50; E04F 15/02183

See application file for complete search history.

(56) References Cited

U.S. PATENT DOCUMENTS 3,094,848 A * 6/1963 Albrecht ..... E02B 3/068 108/159
4,277,923 A * 7/1981 Rebentisch ..... E04F 15/02458 52/126.6
4,398,849 A * 8/1983 Moran ..... E02B 3/068 114/267
4,546,581 A * 10/1985 Gustafson ..... E02D 27/00 52/126.6
4,759,162 A * 7/1988 Wyse ..... E04H 3/24 52/126.6
4,912,887 A * 4/1990 Sullivan ..... E04H 3/28 52/646
5,050,353 A * 9/1991 Rogers ..... E04H 3/28 52/118
5,301,480 A * 4/1994 Oyama ..... E04F 15/02482 52/126.6
5,417,468 A 5/1995 Baumgartner
5,848,501 A * 12/1998 Taipale ..... E04F 11/002 52/126.4
5,899,518 A * 5/1999 Schreiner ..... B60P 3/36 108/44

(Continued)

FOREIGN PATENT DOCUMENTS

FR 2898374 A1 * 9/2007 ..... E04H 3/28

*Primary Examiner* — Elizabeth A Quast
(74) *Attorney, Agent, or Firm* — Richard D. Okimaw

(57) ABSTRACT

A collapsible and portable deck system comprising: a) a collapsible support frame configured to support a deck base portion comprising a plurality of frame members coupled in a scissor structure and configured to be expanded from a collapsed position to an extended position, comprising i. a plurality of frame members, ii. a plurality of corner upright frame members; iii. a plurality of middle upright frame members; iv. a plurality of upper connector assemblies; and v. a plurality of lower connector assemblies; and b) a modular deck base portion, comprising i. at least two first deck support members, ii. a plurality of second deck support members, and iii. a plurality of interconnected deck boards.

18 Claims, 7 Drawing Sheets

(56) References Cited

U.S. PATENT DOCUMENTS

| | | | | |
|---|---|---|---|---|
| 5,997,073 | A | 12/1999 | Vanderhoof | |
| 6,128,880 | A * | 10/2000 | Meenan, Jr. | E02B 3/068 403/231 |
| 6,194,051 | B1 * | 2/2001 | Gagas | E02B 3/068 428/192 |
| 6,502,893 | B1 | 1/2003 | Corliss | |
| 6,695,541 | B1 * | 2/2004 | Spence | E02B 3/068 114/263 |
| 6,729,075 | B2 * | 5/2004 | Jines | E04H 3/126 52/182 |
| 7,093,888 | B2 | 8/2006 | Anderson | |
| 8,074,669 | B2 | 12/2011 | Collins | |
| 8,166,901 | B2 * | 5/2012 | Gerst | B63B 35/38 114/220 |
| 2008/0295246 | A1 | 12/2008 | Yui | |
| 2009/0229644 | A1 * | 9/2009 | Collins | A47C 19/126 135/95 |

* cited by examiner

COLLAPSIBLE AND PORTABLE MODULAR DECK SYSTEM

FIELD OF THE INVENTION

The present disclosure is in the field of portable and collapsible modular deck systems that can be easily transported and setup from one location to another.

BACKGROUND OF THE DISCLOSURE

Conventionally, decks are constructed or manufactured to be a permanent addition to a structure, house trailer or mobile home and time consuming to construct and very difficult to transport from one location to another. This problem is especially prevalent with an owner of a house trailer or mobile home with a deck when the owner relocates the house trailer or mobile home. In such instances, the owner is faced with the difficult task of a conventional deck being disassembled completely and the individual parts transported in a moving truck or other large vehicle when the owner moves to another location.

Expandable and collapsible frames marketed and developed have primarily been directed toward platforms for sleeping. Certain types of mechanisms employ a scissor type frame design that comprise support members, foot members and leg members that when not in use are collapsed for storage.

There is a need for a multi-purpose portable and collapsible deck that comprises a collapsible frame and modular deck system that can be easily transported, erected, disassembled and transported to a new location that employs lightweight components.

SUMMARY OF THE INVENTION

A collapsible and portable deck system comprising: a) a collapsible A collapsible and portable deck system comprising: a) a collapsible support frame configured to support a deck base portion comprising a plurality of frame members coupled in a scissor structure and configured to be expanded from a collapsed position to an extended position, comprising i. a plurality of frame members, wherein each frame member comprising a first end, a second end and an intermediate frame portion therebetween, wherein each pair of frame members are coupled in a scissor structure comprise a frame pivot, wherein each frame pivot connecting two frame members of each of the plurality of frame members at the intermediate portion; ii. a plurality of corner upright frame members; iii. a plurality of middle upright frame members; iv. a plurality of upper connector assemblies; and v. a plurality of lower connector assemblies, wherein each frame member has an upper end and a lower end, wherein each upper end is pivotally attached to a corresponding upper connector assembly with a fastener and each lower end is pivotally attached to a lower connector assembly with a fastener, and wherein in the extended position the one of the plurality of upper connector assemblies and the lower connector assemblies configured substantially planar and capable of supporting a modular deck base portion, one or more users and/or furniture; and b) a modular deck base portion, comprising i. at least two first deck support members; ii. a plurality of second deck support members; and iii. a plurality of interconnected deck boards, wherein the first deck support members are connected and supported by a plurality of upper connector assemblies spaced along a first side and second side of the collapsible support frame, wherein the plurality of second deck support members are connected and supported by the first deck support members and aligned at about 90 degrees relative to the first deck support members and spaced at intervals along the length of the first deck support members configured substantially planar and capable of supporting the plurality of interconnected deck boards, and wherein the deck boards are aligned at about parallel relative to the first deck support members and connected to the second deck support members and substantially covering the upper connector assemblies.

DETAILED DESCRIPTION OF THE EMBODIMENTS

Figure 1:
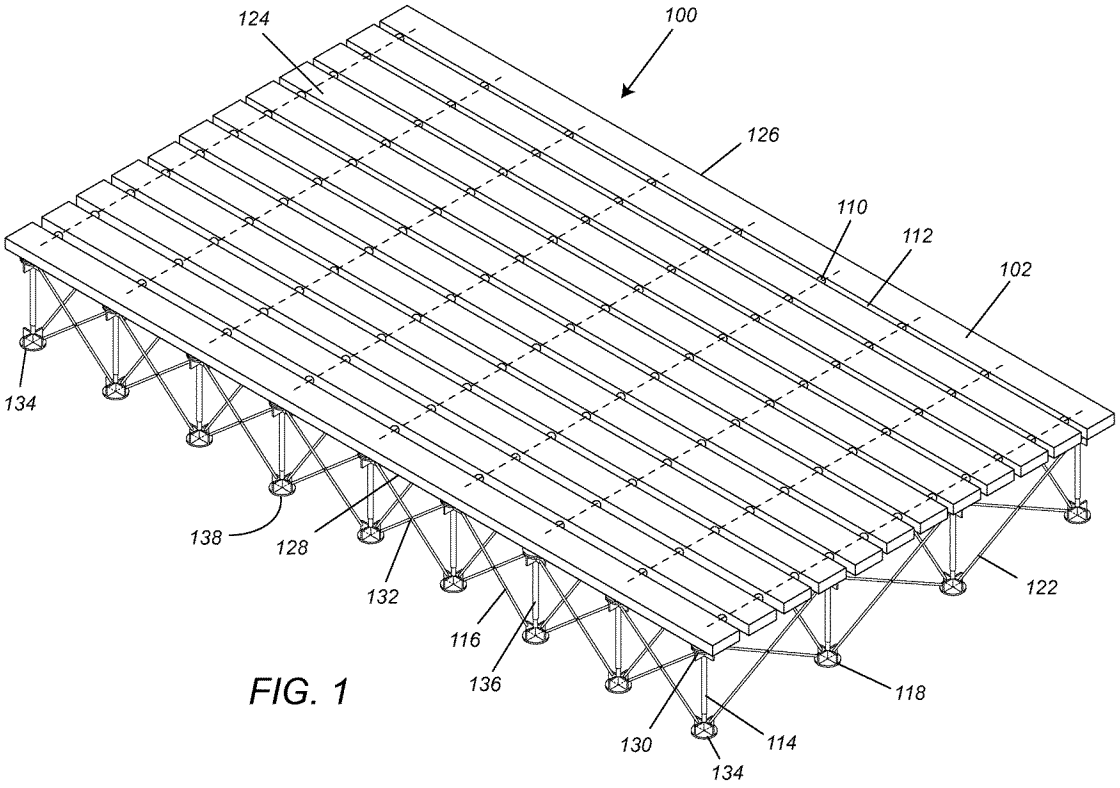
FIG. 1 is a top and side view of the collapsible and portable deck system 100 with a collapsible support frame and terminal deck boards 102 and middle deck boards 124.

The following is a detailed description of certain specific embodiments of the portable and collapsible deck systems disclosed herein. In this description reference is made to the drawings.

Definitions

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Introduction

In one aspect, disclosed herein is a collapsible and portable deck system comprising: a) a collapsible support frame configured to support a deck base portion comprising a plurality of frame members coupled in a scissor structure and configured to be expanded from a collapsed position to an extended position, comprising i. a plurality of frame members, wherein each frame member comprising a first end, a second end and an intermediate frame portion therebetween, wherein each pair of frame members are coupled in a scissor structure comprise a frame pivot, wherein each frame pivot connecting two frame members of each of the plurality of frame members at the intermediate portion; ii. a plurality of corner upright frame members; iii. a plurality of middle upright frame members; iv. a plurality of upper connector assemblies; and v. a plurality of lower connector assemblies, wherein each frame member has an upper end and a lower end, wherein each upper end is pivotally attached to a corresponding upper connector assembly with a fastener and each lower end is pivotally attached to a lower connector assembly with a fastener, and wherein in the extended position the one of the plurality of upper connector assemblies and the lower connector assemblies configured substantially planar and capable of supporting a modular deck base portion, one or more users and/or furniture; and b) a modular deck base portion, comprising i. at least two first deck support members; ii. a plurality of second deck support members; and iii. a plurality of interconnected deck boards, wherein the first deck support members are connected and supported by a plurality of upper connector assemblies spaced along a first side and second side of the collapsible support frame, wherein the plurality of second deck support members are connected and supported by the first deck support members and aligned at about 90 degrees relative to the first deck support members and spaced at intervals along the length of the first deck support members configured substantially planar and capable of supporting the plurality of interconnected deck boards, wherein the deck boards are aligned at about parallel relative to the first deck support members and connected to the second deck support members and substantially covering the upper connector assemblies, and wherein the upper connector assemblies spaced along a first side and a second side each further comprise a fastener on a top portion capable of securing the first deck support members.

Figure 2:
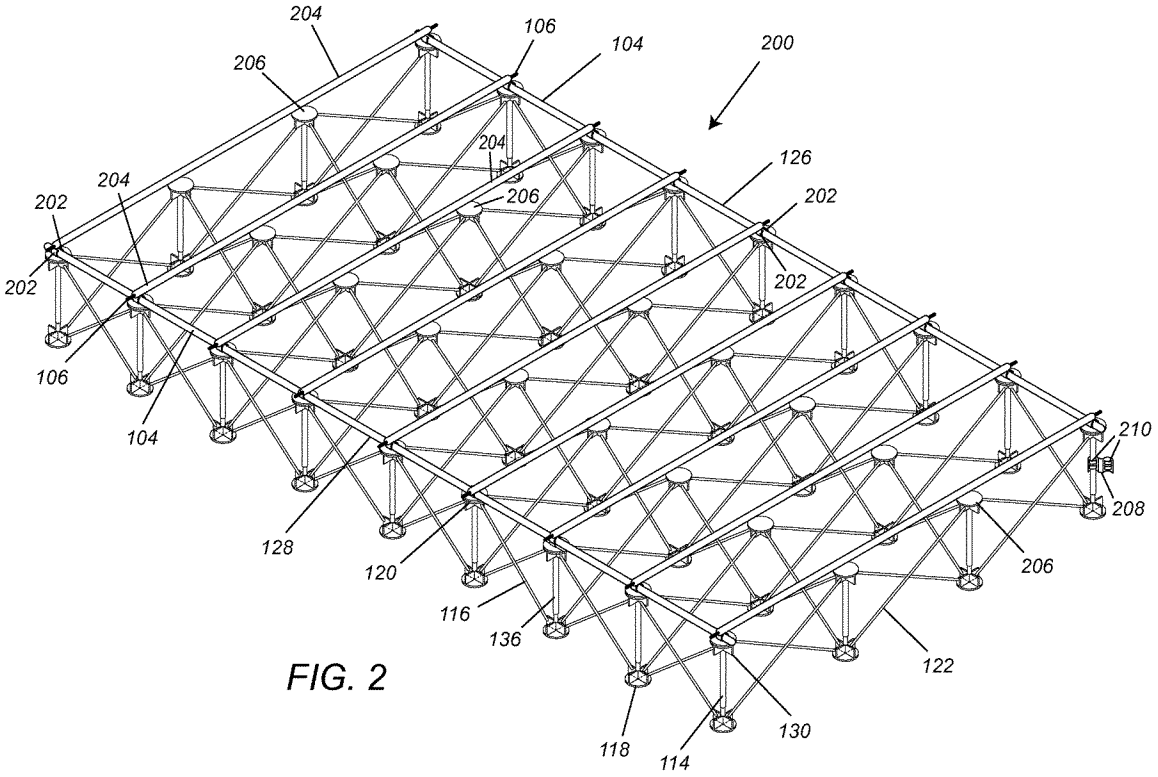
FIG. 2 is a top and side view of the collapsible and portable deck system 200 with a collapsible support frame two first deck support members 104 and a plurality of second deck support members 204.
Figure 3:
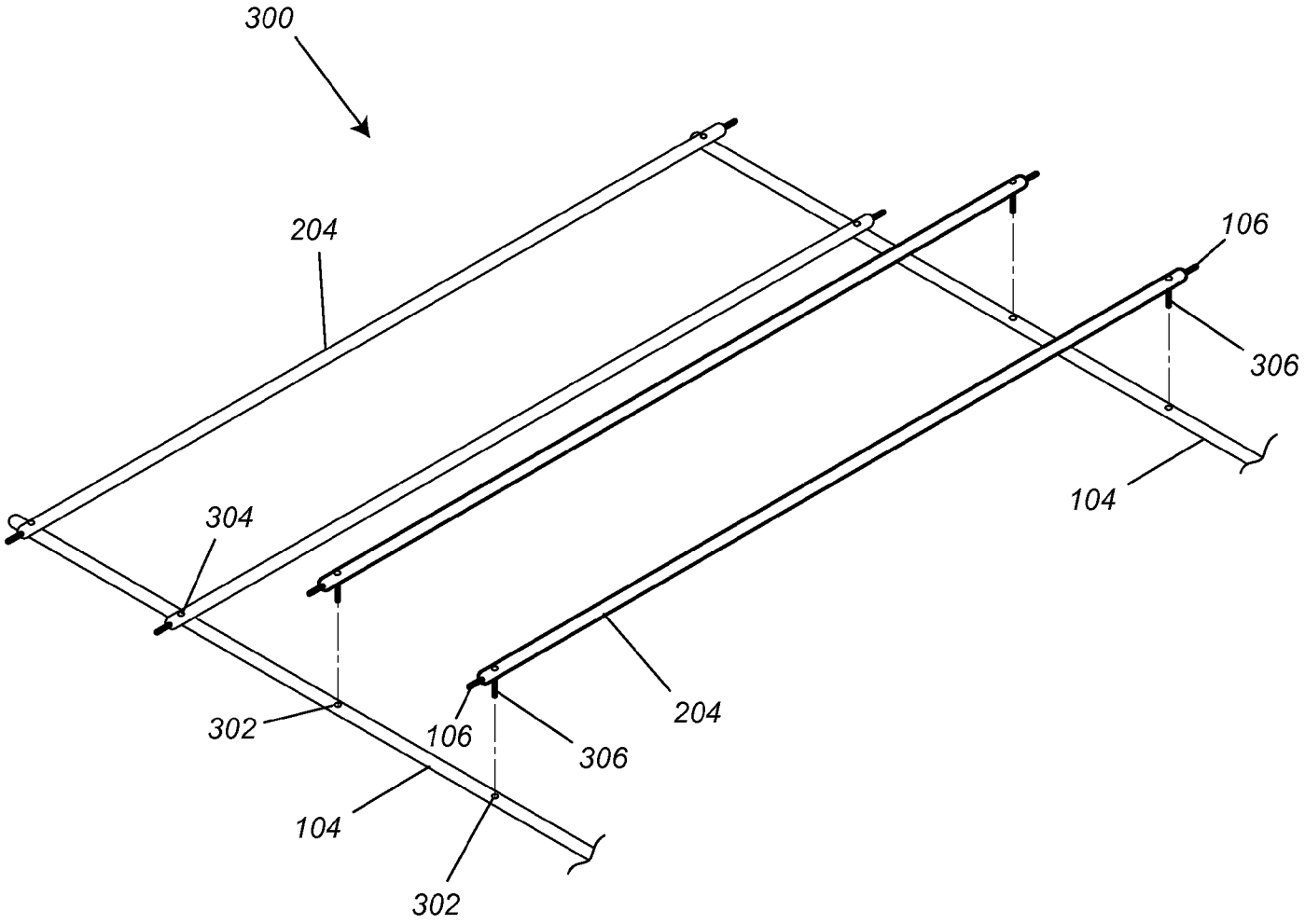
FIG. 3 is a top view of the collapsible and portable deck system 300, depicting the first deck support members 104 and a plurality of second deck support members 204.

Referring to the drawings, FIGS. 1-3 illustrate a collapsible and portable deck system 100 that comprises a collapsible support frame comprising, a plurality of corner upright frame members 114, a plurality of middle upright frame members 136, a plurality of frame members 116 and 122, a plurality of frame pivots 132, a plurality of upper connector assemblies 120, a plurality of lower connector assemblies 118, corner upper connector assemblies 130 and corresponding corner lower connector assemblies 134. An example of a corner upper connector assembly 700 illustrating an upper connector assembly fastener 202 is depicted with FIG. 7. Furthermore, the plurality of upper connector assemblies 120 may also each comprise an upper connector assembly fastener 202 as illustrated with FIG. 2. Further details regarding a general description of a collapsible support frame is described in other patents, including U.S. Pat. No. 7,114,205, the relevant disclosure is included herein by reference. The description and embodiments of the collapsible support frame is described in the reference indicated above, and incorporated herein by reference. Modifications of the collapsible support frame, in addition to those shown and described herein will become apparent to those skilled in the art.

The materials used with manufacturing the frame members and connector assemblies may be varied depending on the overall size of the collapsible and portable deck system 100 and weight supporting requirements. In some embodiments, the frame members and connector assemblies are comprised of aluminum, steel, titanium, carbon fiber, plastic, compostable materials and/or biodegradable materials. The distance between the upper connector assemblies 120 of the collapsible support frame along the length of a first side 128 and a second side 126 and the corresponding lower connector assemblies may vary depending on the overall deck size and weight support needed. In some embodiments, the frame members 116 and 122 are each independently about 12 inches to 36 inches in length. In some embodiments, the plurality of corner upright frame members 114 and the plurality of middle upright frame members 136 are each independently about 6 inches to 36 inches in length. In some embodiments, the plurality of corner upright frame members 114, plurality of middle upright frame members 136, and plurality of frame members 116 and 122 are each independently comprised of tubing with a diameter between about 0.5 inches to about 3 inches. In some embodiments, the distance between adjacent horizontal upper connector assemblies 120 of the collapsible support frame along a first side 128 and a second side 126 is between about 8 inches and 36 inches. The surface area size of the collapsible and portable deck system 100 may be between about 36 square feet to 1000 square feet. In some embodiments, the deck system 100 is sized with a length of about 36 feet, width of about 36 feet and height of about 18 inches. In some embodiments, the deck system 100 is sized with a length of about 18 feet, width of about 18 feet and height of about 18 inches.

Referring to the drawings, FIGS. 1 and 2 illustrate a collapsible and portable deck system 100 and 200, comprising, at least two first deck support members 104, a plurality of frame members interconnected to each other at pivots 132, some of which are positioned at the midpoints of the frame members 116 and 122 and the corresponding frame members at pivots 132. In some embodiments, the collapsible and portable deck system further comprises at least one extendable corner upright coupled to a corner upper connector assembly and a corresponding corner lower connector assembly. In some embodiments, the at least one corner upright is slidably extendable. In some embodiments, the collapsible and portable deck system further comprises at least one extendable middle upright coupled to an upper connector assembly and a corresponding lower connector assembly. In some embodiments, the at least one middle upright is slidably extendable. In some embodiments, each corner upright is extended with the support frame in a collapsed position. In some embodiments, each corner upright and each middle upright are extended with said support frame in a collapsed position. In some embodiments, the plurality of upper connector assemblies and the plurality of lower connector assemblies support the deck base portion in the extended position. In some embodiments, the plurality of upper connector assemblies and the plurality of lower connector assemblies support the deck base portion, and one or more users and/or furniture in the extended position. In some embodiments, each lower connector assembly comprises a low friction device 138. In some embodiments, a low friction device is coupled to the bottom portion of the plurality of lower connector assemblies, wherein the low friction device 138 comprises a low friction pad. In some embodiments, the diameter of the bottom portion of the lower connector assemblies is between 1.5 inches and 8 inches. In some embodiments, the diameter of the bottom portion of the lower connector assemblies is between 1.5 inches and 3 inches. The diameter of a corresponding top portion of the upper connector assemblies is between 1.5 inches and 8 inches. In some embodiments, the diameter of the top portion of the upper connector assemblies is about 2 inches.

Figure 7:
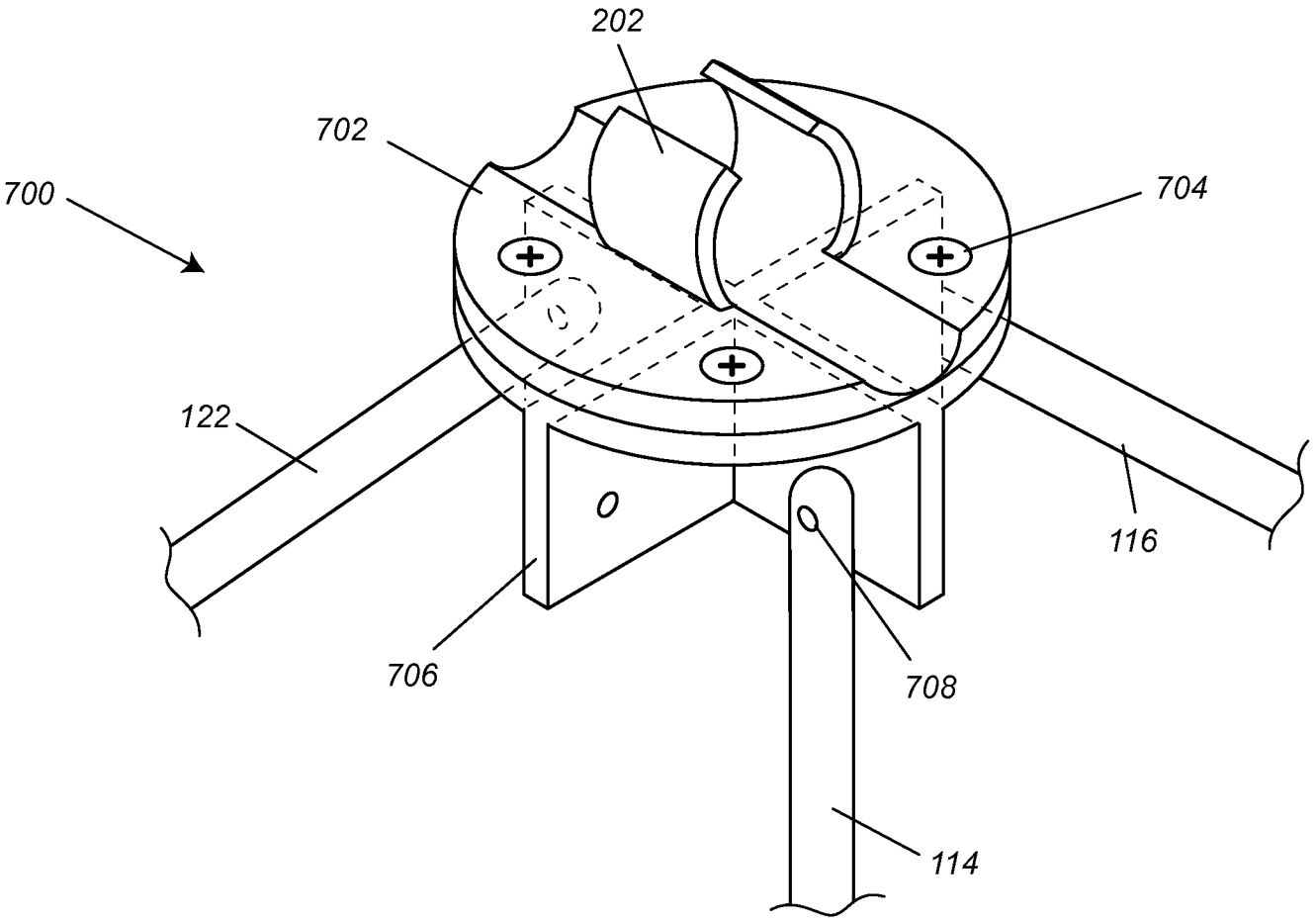
FIG. 7 is a detail view of an upper connector assembly 700, depicting an upper connector assembly fastener 202 that is capable of securing a first deck support member 104.

FIG. 2 illustrates that the first deck support members 104 are connected with the corresponding upper connector assemblies 120 and corner upper connector assemblies 130 of the collapsible support frame along a first side 128 and a second side 126 with an upper connector assembly fastener 202. In some embodiments, the upper connector assemblies spaced along a first side and a second side each further comprise an upper connector assembly fastener 202 of an upper connector assembly top portion 702 depicted in FIG. 7 is capable of securing the first deck support members 104. In some embodiments, the upper connector assembly fastener 202 of an upper connector assembly top portion 702 is connected to a the pivot assembly 706 with fasteners 704 as illustrated with FIG. 7. In some embodiments, the upper connector assembly fasteners 202 are capable of securing the first deck support members 104 along the first side and the second side, wherein the upper connector assembly fastener 202 is comprised of a pinch clamp, groove, two flexible prongs, opposed living hinges, clamps and/or straps or a combination thereof.

Furthermore, the plurality of upper connector assemblies 130, plurality of lower connector assemblies 118, corner upper connector assemblies 130 and corresponding corner lower connector assemblies 134, some or all of which include pivot assemblies 706 and pivots 708 as depicted with FIG. 7. For example and illustration purposes the pivot assemblies 706 and pivots 708 connect all the frame members to each other, for ease of expanding, collapsing and transporting. In some embodiments, the collapsible and portable deck system further comprises a) a plurality of first pivot assemblies, wherein each first pivot assembly is pivotally attached the first end of a frame member to a corresponding upper connector assembly; and b) a plurality of second pivot assemblies, wherein each second pivot is pivotally attached the second end of a frame member to a corresponding lower connector assembly.

The frame can be thought of as an extended scissors-frame assembly that allows the frame as a whole to be collapsed or expanded in a very easy and efficient manner. Force directed at any one of the corners causes movement in all the other corners, so that there is movement of the whole frame in either an inward or outward direction, relative to a central area. The pivots 708 as illustrated with FIG. 7 allow the support frame to move towards a central area from all sides as a unit when the frame is being collapsed, and to move away from this central area when expanding the support frame.

Figure 4:
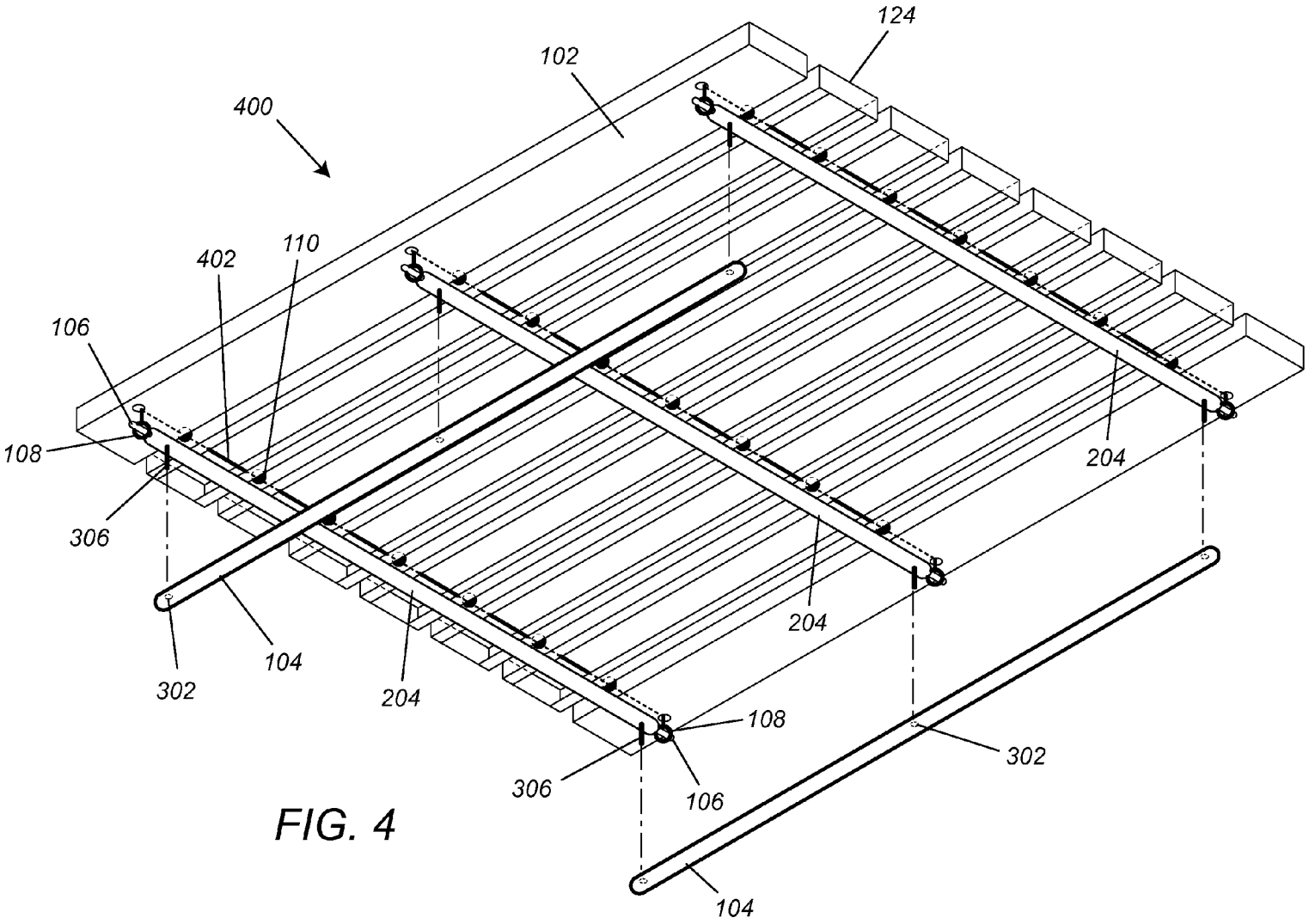
FIG. 4 is an isometric top view of the collapsible and portable deck system 400, depicting the first deck support members 104 and a plurality of second deck support members 204 and a terminal deck board 102 and middle deck boards 124 interconnected with ropes 402.
Figure 5:
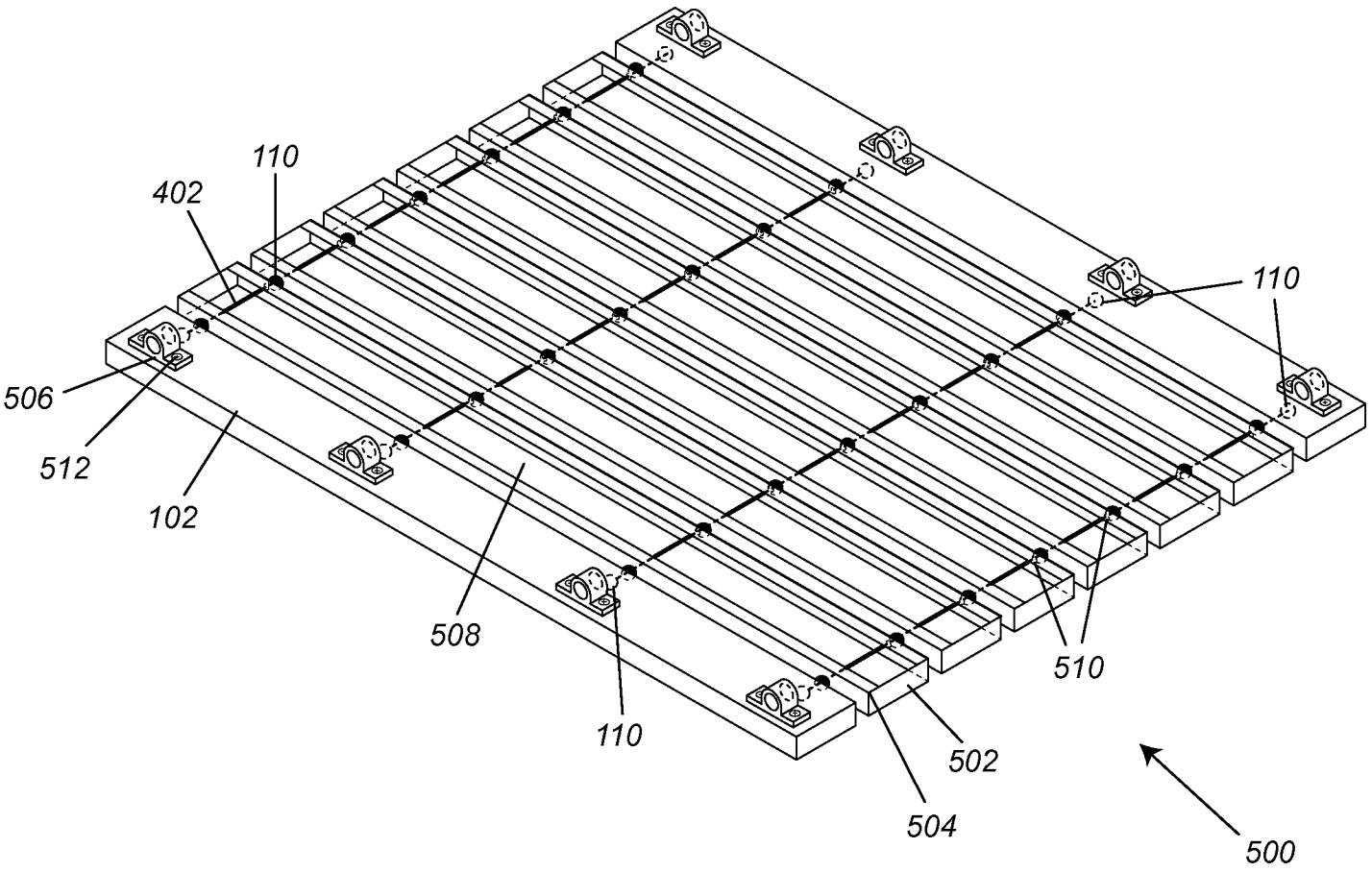
FIG. 5 is an underside view of the collapsible and portable deck system 500, depicting the terminal deck boards 102 and middle deck boards 124 interconnected with ropes 402 and bumper stops 110.
Figure 6:
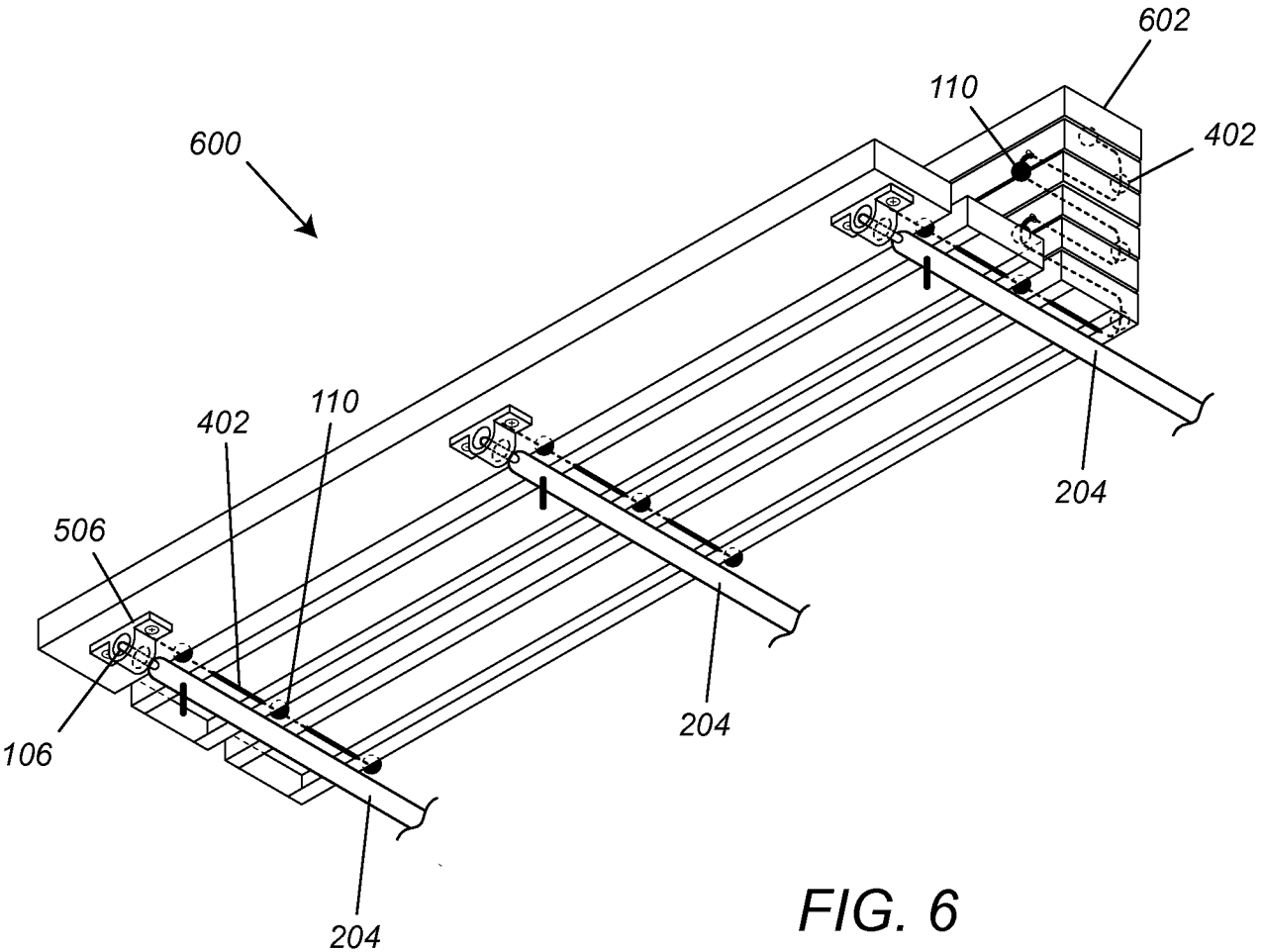
FIG. 6 is a side view of the collapsible and portable deck system 600, depicting a stack of the terminal deck board 102 and middle deck boards 124 interconnected with ropes 402 and depicting the stacking of the deck boards during disassembly prior to transportation of the portable and collapsible deck system.

During the assembly of the collapsible and portable deck system 100, whereby the collapsible support frame is in an extended position, the two first deck support members 104 are connected with the corresponding upper connector assemblies 120 via the upper connector assembly fasteners 202 spaced along a first side and a second side as depicted with FIG. 2. Next, a plurality of second deck support members 204 are interconnected 304 with the two first deck support members 104 via first deck support member openings 302 and the second deck support member pins and/or hooks 306 as depicted with FIGS. 2-4. In some embodiments, the first deck support member openings 302 are spaced at intervals of between about 3 inches and 36 inches. In some embodiments, the first deck support members comprise openings on an upper face spaced at intervals along the length of the first deck support members, wherein the plurality of second deck support members further comprise pins and/or hooks on a bottom side spaced at intervals along the length of the second deck support members that are capable of interconnecting the second deck support members with the first deck support members via the openings of the first deck support members. Moreover, as depicted in FIG. 2, the collapsible support frame comprises a plurality of middle upper connector assemblies 206 and the corresponding lower connector assemblies. In some embodiments, the collapsible support frame further comprises a plurality of middle upper connector assemblies positioned along a bottom portion of the second deck support members and capable of supporting the second deck support members.

Final assembly, as illustrated with FIGS. 2-6, include laying a stack of interconnected deck boards 602 as illustrated with the collapsible and portable deck system 600, which depicts a stack of the interconnected deck boards comprising two terminal deck board 102 and middle deck boards 124 configured parallel and on top of the first deck support members 104. In some embodiments, each of the deck boards further comprise at least two ropes, cords or straps 402 capable of interconnecting each deck board with each adjacent deck board in series and bumper stops 110 positioned therebetween each deck board. The bumper stops 110 are capable of allowing for a gap 112 between adjacent deck boards as depicted with FIG. 1. Moreover, as illustrated with FIG. 5, bumper stops 110 are present at the terminal ends of the at least two ropes, cords or straps 402 of terminal deck boards 102. In some embodiments, the at least two ropes, cords or straps 402 interconnect each adjacent deck boards in series as depicted with the underside view of the deck boards of the collapsible and portable deck system 500 via openings 510. In some embodiments, the openings 510 and corresponding ropes, cords or straps 402 are spaced along a series of deck boards at parallel intervals between about 12 inches and 36 inches as illustrated with FIGS. 4-6. In some embodiments, the bumper stops 110 comprise rubber or plastic and encase the at least two ropes, cords or straps 402. In some embodiments, the bumper stops afford a gap between adjacent deck boards between about 0.5 inches to about 1.5 inches. The deck boards comprising a plurality of interconnected deck boards including, terminal deck boards 102 and middle deck boards 124, which are interconnected for ease of assembly, disassembly, storage and transportation have a width of between about 4.5 inches and 10 inches, a length of between about 6 feet to about 16 feet and thickness of between about 1 inch to about 3 inches.

Referring to the drawings, FIGS. 2 and 4-6, illustrate that during assembly with the aid of the ropes, cords or straps 402 and deck board fasteners 108 and/or 506, the terminal deck board 102 is connected to the second deck support members a fastener 106 comprising a terminal pin or a terminal hook and the remaining deck boards 102 and 124 are unrolled and moved into position as configured to cover the support frame 200. In some embodiments, the ropes, cords or straps 402 terminate with deck board fasteners 108 comprising loops from each terminal end of the ropes, cords or straps 402 as depicted with FIG. 4. The terminal deck boards 102 comprise deck board fasteners comprising a loop of rope or strap 108 or a clamp 506 configured to interconnect the terminal deck boards 102 with the second deck support members via a fastener 106 comprising a terminal pin or a terminal hook. In some embodiments, the second deck support members further comprise a fastener comprising a terminal pin or a terminal hook that each extend from each terminal end of each second deck support member and are each independently capable of each being inserted into one or more deck board fasteners spaced at intervals along a first side and a second side or an underside portion of each terminal deck board. In some embodiments, one or more second deck support members further comprise a fastener comprising a terminal pin or a terminal hook that each extend from each terminal ends of each second deck support member. In some embodiments, the terminal pin or a terminal hook extends from the terminal ends of every second, third or fourth of the second deck support members in series. In some embodiments, the collapsible and portable deck system further comprises one or more deck board fasteners spaced at intervals along a first side and a second side or an underside portion of each terminal deck board, wherein each deck board fastener comprises a clamp, loop of rope or strap.

In some embodiments, when the deck boards are disconnected from the second deck support members fastener 106, the deck boards can be pulled and stacked with a portion of slack with the ropes, cords or straps interconnecting each deck board to an adjacent deck board allowing for the stacked deck boards to be efficiently transported or inserted in a deck base portion storage bag and/or a collapsible and portable deck system storage bag. The deck boards as depicted with FIG. 5 comprise end caps 502, which may be comprised of rubber, metal, plastic or other suitable material. The terminal deck boards 102 and middle deck boards 124 may comprise a lightweight hollow structure as depicted with deck board cavity 508 and side portions 504, which allow for a lightweight and structurally rigid deck boards. In some embodiments, terminal deck boards 102 comprise a deck board cavity 508, but further comprising a bottom portion as depicted with FIG. 5, whereby deck board fasteners 506 are connected via one or more nut and bolts, screws 512, glue or another suitable means.

In some embodiments, the collapsible and portable deck comprises a kit that includes the collapsible support frame, two first deck support members, a plurality of second deck support members, a plurality of interconnected deck boards and one or more collapsible and portable deck system storage bags.

Referring to the drawings, FIG. 2 illustrates and example of a clamp or fastener that is capable of joining two or more collapsible and portable deck systems in series. In some embodiments, the at least one corner upright, the collapsible support frame, or the deck base portion further comprises a clamp 208 to interconnect two or more collapsible and portable deck systems in series for expanded deck space. In some embodiments, the at least one corner upright, the collapsible support frame, or the deck base portion further comprises a clamp 208 comprising one or more fasteners comprising nuts and bolts 210 or another suitable fastener to interconnect two or more collapsible and portable deck systems in series for expanded deck space.

In some embodiments, the collapsible support frame, and the deck base portion are each independently comprised of aluminum, steel, carbon fiber, plastic, rubber, wood, biodegradable materials, compostable materials, or combinations thereof. In some embodiments, the collapsible and portable deck is lightweight and may be assembled in a matter of minutes and disassembled and stored for convenient transportation.

In some embodiments, the collapsible and portable deck will find uses with users of recreational vehicles, mobile homes, camping equipment, private homes, etc. The collapsible and portable deck disclosed herein can provide additional space in minutes for patio furniture and lawn chairs, BBQ, and make any area look and feel like home. Moreover, the use of the collapsible and portable deck disclosed herein will reduce dirt, sand and debris from being tracked into recreational vehicles, mobile homes, camping equipment, private homes, etc. In some embodiments, the collapsible and portable deck is about 6 inches to 24 inches off the ground and therefore, no railing may be required.

In some embodiments, the collapsible and portable deck may provide an elevated landing adjacent to a recreational vehicle, mobile home or other structure reducing the chance of injury. In some embodiments, the collapsible and portable deck may find uses with parties, weddings, bands, dance floor, or paired with a gazebo and/or patio furniture. In some embodiments, the collapsible and portable deck may find uses as a movie set for instant flooring space or flat surface. In some embodiments, the collapsible and portable deck may find uses two, three or several decks can be hooked together to create a very large area.

The presently disclosed collapsible and portable deck system is not to be limited in scope by the specific embodiments described herein, which are intended as single illustrations of individual aspects of the presently disclosed devices and methods, and functionally equivalent devices, methods and components are within the scope of the presently disclosed collapsible and portable deck systems. Indeed, various modifications of the presently disclosed collapsible and portable deck system, in addition to those shown and described herein will become apparent to those skilled in the art from the foregoing description and accompanying drawings. Such modifications are intended to fall within the scope of the appended claims.

What is claimed is:

1. A collapsible and portable deck system comprising:

a) a collapsible support frame configured to support a deck base portion and configured to be expanded from a collapsed position to an extended position, comprising i. a plurality of diagonal frame members, wherein each diagonal frame member comprising a first end, a second end and an intermediate frame portion therebetween, wherein pairs of diagonal frame members are coupled in a scissor structure comprising a frame pivot, wherein each frame pivot connecting two of the diagonal frame members of each of the plurality of diagonal frame members at the intermediate portion;

ii. a plurality of slidably extendable corner upright frame members;

iii. a plurality of slidably extendable middle upright frame members;

iv. a plurality of upper connector assemblies; and v. a plurality of lower connector assemblies, wherein each diagonal frame member has an upper end and a lower end, wherein each upper end is pivotally attached to a corresponding of the plurality of upper connector assemblies with a fastener and each lower end is pivotally attached to a corresponding of the lower connector assemblies with a fastener, and wherein in the extended position the one of the plurality of upper connector assemblies and the lower connector assemblies configured to be substantially planar and capable of supporting a deck modular base portion; and b) a modular deck base portion, comprising i. at least two first deck support members;

ii. a plurality of second deck support members; and iii. a plurality of interconnected deck boards, wherein the first deck support members are connected and supported by the plurality of upper connector assemblies spaced along a first side and second side of the collapsible support frame, wherein the plurality of second deck support members are connected and supported by the first deck support members and aligned at about 90 degrees relative to the first deck support members and spaced at intervals along the length of the first deck support members wherein the first deck support members are configured to be substantially planar and capable of supporting the plurality of interconnected deck boards, and wherein the deck boards are aligned at about parallel relative to the first deck support members and connected to the second deck support members and substantially covering the plurality of upper connector assemblies.

2. The collapsible and portable deck system of claim 1, further comprising a plurality of first pivot assemblies, wherein each first pivot assembly is pivotally attached the first end of a diagonal frame member to a corresponding of the plurality of upper connector assembly; and a plurality of second pivot assemblies, wherein each second pivot is pivotally attached the second end of a diagonal frame member to a corresponding lower connector assembly.

3. The collapsible and portable deck system of claim 1, wherein the upper connector assemblies spaced along a first side and a second side each further comprise an upper connector assembly fastener on a top portion capable of securing the first deck support members.

4. The collapsible and portable deck system of claim 3, wherein the upper connector assembly fasteners are capable of securing the first deck support members along the first side and the second side, wherein the upper connector assembly fastener are selected from the group consisting of a pinch clamp, groove, two flexible prongs, opposed living hinges, clamps, straps and combinations thereof.

5. The collapsible and portable deck system of claim 1, wherein the first deck support members comprise openings on an upper face spaced at intervals along the length of the first deck support members, wherein the plurality of second deck support members are selected from the group consisting of pins and hooks on a bottom side spaced at intervals along the length of the second deck support members that are capable of interconnecting the second deck support members with the first deck support members via the openings of the first deck support members.

6. The collapsible and portable deck system of claim 1, wherein the second deck support members further comprise a fastener comprising a terminal pin or a terminal hook that each extend from each terminal end of each second deck support member and are each independently capable of each being inserted into one or more deck board fasteners spaced at intervals along a first side and a second side or an underside portion of a terminal deck board.

7. The collapsible and portable deck system of claim 1, further comprising one or more deck board fasteners spaced at intervals along a first side and a second side or an underside portion of each terminal deck board, wherein each deck board fastener comprises a clamp, loop of rope or strap.

8. The collapsible and portable deck system of claim 1, wherein each of the deck boards further comprise at least two ropes, cords or straps capable of interconnecting each deck board with each of the adjacent deck boards in series.

9. The collapsible and portable deck system of claim 8, wherein the deck boards can be stacked with a portion of slack with the ropes to be efficiently transported or inserted in a modular deck base portion storage bag.

10. The collapsible and portable deck system of claim 1, further comprising middle upper connector assemblies positioned along a bottom portion of the second deck support members and capable of supporting the second deck support members.

11. The collapsible and portable deck system of claim 1, wherein the collapsible support frame and the modular deck base portion are each independently comprised of aluminum, steel, carbon fiber, plastic, rubber, wood, biodegradable materials, compostable materials, or combinations thereof.

12. The collapsible and portable deck system of claim 1, wherein the collapsible and portable deck comprises a kit that includes the collapsible support frame, two first deck support members, a plurality of second deck support members, a plurality of interconnected deck boards and one or more collapsible and portable deck system storage bags.

13. The collapsible and portable deck system of claim 1, wherein the at least one corner upright, the collapsible support frame or the deck base portion further comprises a fastener to interconnect two or more collapsible and portable deck systems in series for expanded deck space.

14. The collapsible and portable deck system of claim 1, wherein the at least one corner upright frame member and middle upright frame member are slidably extendable.

15. The collapsible and portable deck system of claim 1, wherein the plurality of upper connector assemblies and the plurality of lower connector assemblies supports the deck base portion in the extended position.

16. The collapsible and portable deck system of claim 1, wherein the plurality of upper connector assemblies and the plurality of lower connector assemblies supports the deck base portion, and one or more users and/or furniture in the extended position.

17. The collapsible and portable deck system of claim 1, wherein the at least one corner upright frame member and/or middle upright frame member is/are extended with said support frame in a collapsed position.

18. The collapsible and portable deck system of claim 1, wherein a low friction device is coupled to the bottom of the plurality of lower connector assemblies, wherein the low friction device comprises a low friction pad.

* * * * *